US006068127A

United States Patent [19]

Hunter

[11] Patent Number: 6,068,127

[45] Date of Patent: May 30, 2000

[54] CONTAINER CARRIER, BASE AND ADVERTISING/PROMOTIONAL TRANSPORT

[76] Inventor: Anthony L. Hunter, P. O. Box 4262, Mission Viejo, Calif. 92690

[21] Appl. No.: 09/056,480

[22] Filed: Apr. 7, 1998

[51] Int. Cl.[7] ..... B65D 5/50; B65D 85/62

[52] U.S. Cl. ..... 206/549; 206/194

[58] Field of Search ..... 206/147, 152, 206/167, 170, 174, 175, 194, 216, 427, 541, 549, 163, 195, 196, 199; 294/87.2; 229/904

[56] References Cited

U.S. PATENT DOCUMENTS

| | | | |
|---|---|---|---|
| D. 367,409 | 2/1996 | Hunter . | |
| 2,728,484 | 12/1955 | Farrington . | |
| 2,759,629 | 9/1956 | Sargent . | |
| 2,828,047 | 3/1958 | Weiselberg . | |
| 3,565,323 | 2/1971 | Katzenmeyer . | |
| 3,773,214 | 11/1973 | Lemon | 206/194 |
| 3,780,906 | 12/1973 | Katzenmeyer . | |
| 4,049,116 | 9/1977 | Cope | 206/194 |
| 4,053,099 | 10/1977 | Lock . | |
| 4,155,502 | 5/1979 | Forte . | |
| 5,803,264 | 9/1998 | Gersten et al. | 206/194 |

FOREIGN PATENT DOCUMENTS

| | | | |
|---|---|---|---|
| 532948 | 11/1956 | Canada | 206/194 |
| 728975 | 4/1955 | United Kingdom | 206/194 |

OTHER PUBLICATIONS

Model of beverage container carrier in public use at least by May 31, 1974 as provided in Patent #D367,409 issued Feb. 27, 1996.

*Primary Examiner*—Paul T. Sewell
*Assistant Examiner*—Luan K. Bui
*Attorney, Agent, or Firm*—Kevin Lynn Wildenstein

[57] ABSTRACT

A foldable container carrier and base, the carrier having first and second panels coupled together by a foldable hinge line, the first panel having at least one primary opening and being attached to a first series of panels along a second hinge line, the first series of panels including one panel having a secondary opening and designed to allow the first panel's primary openings to be in substantial registry with the first series of panel's secondary openings; the second panel having one primary opening and being attached to a second series of panels along a third hinge line, the second series of panels including one panel having a secondary opening therein and designed to allow the second panel's primary openings to be in substantial registry with the second series of panel's secondary openings; and a slot formed along the foldable hinge line, the slot adapted to receive a base handle of predetermined size and length.

6 Claims, 14 Drawing Sheets

CONTAINER CARRIER, BASE AND ADVERTISING/PROMOTIONAL TRANSPORT

BACKGROUND OF THE INVENTION

The present invention relates to portable, collapsible container carrier and insertable base for transporting food and beverage containers. The exposed panels of the base and the container carrier are intended to be used as advertising/promotional space. Thus, the present invention is also designed to be an advertising and promotional vehicle.

Description of the Prior Art

In the operation of fast-food carryout at restaurants, stadiums, arenas and other facilities, a number of selected items of food and drink are frequently carried by the patrons. If more than one or two items are to be carried, some type of carrier is typically provided for the patron's convenience. Such a carrier should be inexpensive, readily transportable, compactly stored, and quickly and easily loaded, all without compromising the ability to safely and conveniently carry a number of liquid filled containers. Liquid container carriers for many applications and of various configurations have been disclosed in U.S. Pat. Nos. to: Sargeant, 2,759,629; Farrington, 2,728,484; Weiselberg, 2,828,047; Katzenmeyer, 3,565,323; Lock, 4,053,099; Cowlishaw, 1,001,752; Schnorr, 1,563,443; Flamm, 2,330,699; Tyson, Jr., 2,513,762; Clement, et al., 2,567,054; Siddal, 2,732,983; and Struble, 3,744,704. These container carriers are, for the most part, complex, expensive to manufacture and difficult to store and load. Some require relatively rigid and expensive materials for support. Others require a number of time consuming steps for forming the carriers that are performed by the fast-food operator prior to loading. Where these prior art carriers are capable of flat storage, they generally require a considerable amount of setup time to form the folded parts into its operable configuration, and thus, cause delay in fast-food service. On the other hand, where the prior art carriers are preformed, setup time is considerably decreased but storage problems are increased since the completely unfolded and setup carriers require considerably more storage space.

U.S. patent application Ser. No. 08/745,033, filed Nov. 11, 1995, discloses a bottomless container carrier that is foldable for convenient and efficient transportation and storage. That invention incorporates a number of exposed and interior panels suitable for advertising and/or promotion, and sought to improve the strength and reliability of a container carrier to hold drink containers by providing, for each such drink container, a pair of aligned and spaced apart openings, wherein all aligned openings are elliptical, and wherein the major axis of these aligned elliptical openings are rotationally offset by 90°. That invention also discloses an auxiliary tray and a mechanism to lock the tray in its operative position to maintain "lift" on the handle of the carrier when a consumer sets the carrier down and releases the handle. While the benefits of that invention are amply disclosed, that invention fails to disclose that while that system is more than adequate for smaller orders, it does not address the types of larger dinner-like orders or complete meals sold by restaurants, fast food chains, delicatessens or the like.

The present invention is a fully integrated, foldable base and container carrier system which allows for the novel transport and carrying of items and beverage containers.

Accordingly, it is an object o the present invention to disclose an alternative complete packaging system for carryout restaurant orders that can be placed in a integrated unit for transport to an alternate location.

It is also an object of the present invention to disclose a container carrier device which is designed to be placed over and sit upon a base in saddle-like fashion to form a complete, integrated carrying package, thereby incorporating the convenience of transporting one or more beverage containers with a complete dinner simultaneously.

It is a further object of the present invention to disclose a system that can carry multiple items, such as foods (hot or cold), condiments and flatware, with beverage containers, all of various sizes, without the worry of spillage.

SUMMARY OF THE INVENTION

A foldable container carrier, either alone or in combination with a foldable base, having a first panel and a second panel, the first panel coupled to the second panel by a foldable hinge (or perforated) line, the first panel having at least one primary opening therein and being attached to a first series of panels along a second hinge line, the first series of panels including one panel having at least a secondary opening therein and designed to allow the first panel's primary openings to be in substantial registry with the first series of panel's secondary openings; the second panel having at least one primary opening therein and being attached to a second series of panels along a third hinge line, the second series of panels including one panel having at least a secondary opening therein and designed to allow the second panel's primary openings to be in substantial registry with the second series of panel's secondary openings; the container carrier further having a slot formed substantially along the foldable hinge line between the first and second panels, the slot being sized and dimensioned to receive a base handle of predetermined size and length. Because the container carriers and base have a plurality of external, visible facades, the present invention is conducive to placing or imprinting advertising and promotional items on various panel surfaces as desired. This aspect give the food service operator the opportunity to defray a portion or all of the cost of producing this invention.

DESCRIPTION OF THE PREFERRED EMBODIMENT

Figure 1:
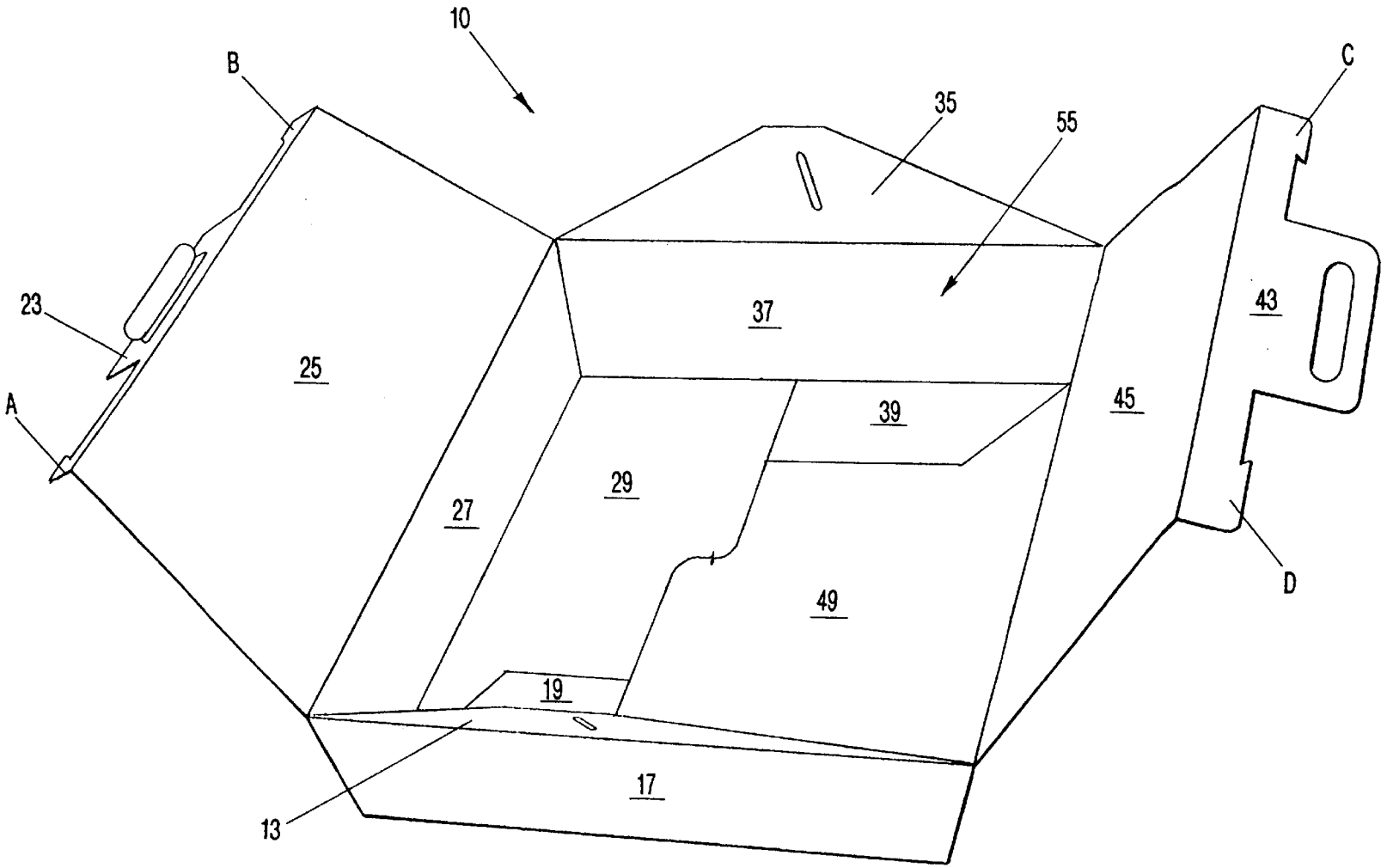
FIG. 1 is a side perspective view of the base constructed in accordance with principles of the present invention in a partially unfolded, loading position.

FIG. 1 illustrates the base constructed in accordance with principles of the present invention, in a constructed, open position ready for loading food, utensils or other items. The base is made by folding a sheet of cardboard 10 or other foldable sheet material in the configuration illustrated in FIG. 2.

Figure 2:
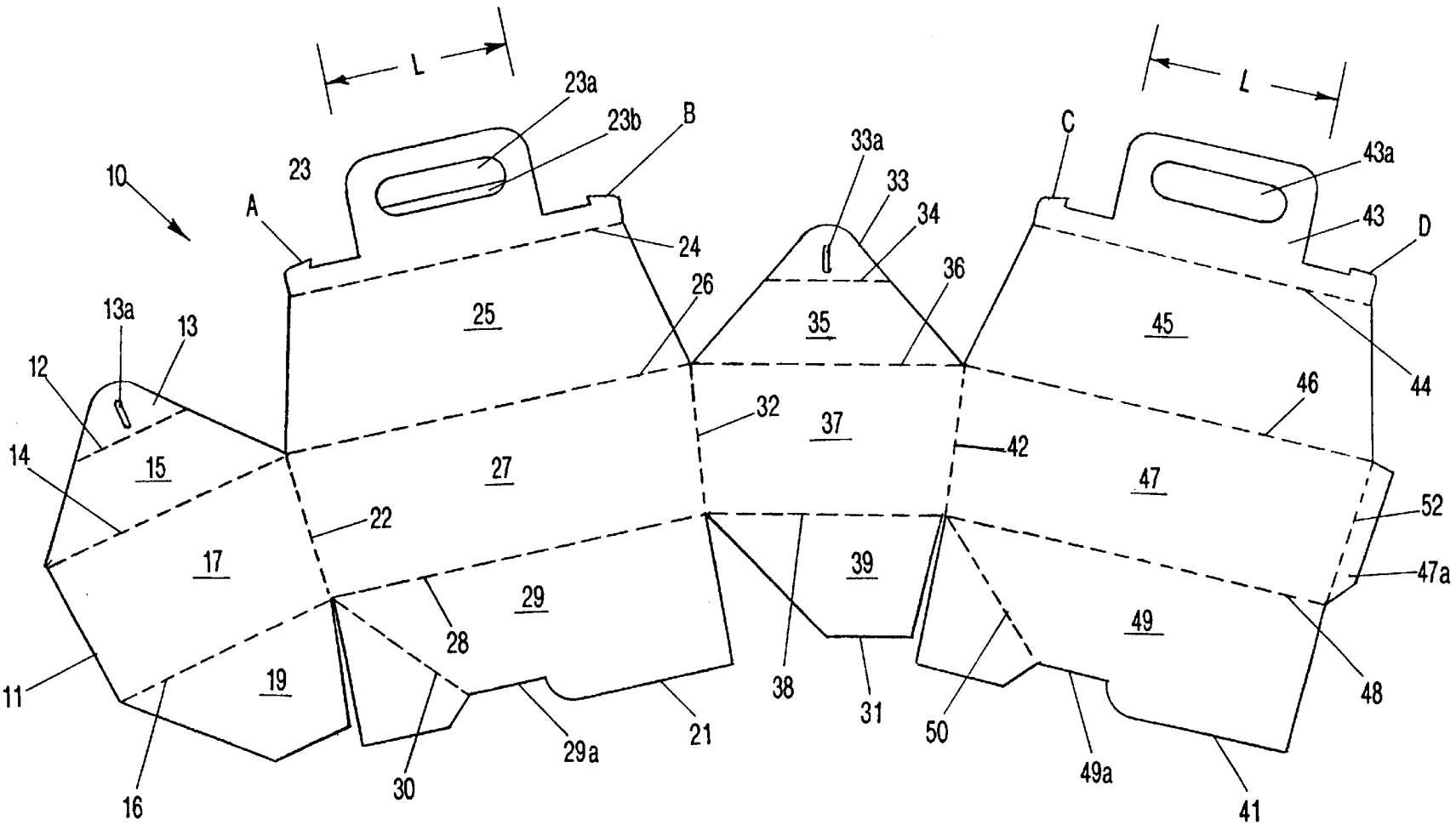
FIG. 2 illustrates a blank sheet from which the base of FIG. 1 is formed.

As seen in FIG. 2, sheet 10 is divided into four primary sections or panels (i.e., 11, 21, 31 and 41) by three substantially parallel fold or hinge lines (i.e., 22, 32 and 42). The first panel 11 includes four subsections (i.e., 13, 15, 17 and 19) which are separated by three substantially parallel fold or hinge lines (i.e., 12, 14 and 16). Subsection 13 is tapered near the top and includes engagement slot 13*a*. Engagement slot 13*a* is adapted to receive and engage locking tab A on subsection 23 and locking tab D on subsection 43 to thereby define a first base locking means.

Second panel 21 is attached between panels 11 and 31 through substantially parallel hinge lines 22 and 32, and includes four subsections (i.e., 23, 25, 27 and 29) which are separated by three substantially parallel fold or hinge lines (i.e., 24, 26 and 28). Subsection 29 further includes fold or hinge line 30. Subsection 23 includes a pair of opposing locking tabs A and B. Each of locking tabs A and B is defined by a pair of opposing protrusions which are dimensionally cut to attach into engagement slots 13*a* and 33*a* in secure relation. Subsection 23 has a protruding portion of a predetermined length L (as seen in FIG. 2) and further includes handle cutout 23*a* and handle reinforcing clasp 23*b*. Subsection 29 includes fold or hinge line 30 and notch 29*a*. Notch 29*a* is designed to engage notch 49*a* in subsection 49 in interlocking relation so that subsections 29 and 49, which are dimensionally larger than subsections 19 and 39, form the primary foundational support for any items placed in base 10.

Third panel 31 is attached between panels 21 and 41 through substantially parallel hinge lines 32 and 42, and includes four subsections (i.e., 33, 35, 37 and 39) which are separated by three substantially parallel fold or hinge lines (i.e., 34, 36 and 38). Subsection 33 is tapered near the top and includes engagement slot 33*a*. Engagement slot 33*a* is adapted to receive and engage locking tab B on subsection 23 and locking tab C on subsection 43 to thereby define a second base locking means.

Forth panel 41 is attached to panel 31 through substantially parallel hinge line 42, and includes four subsections (i.e., 43, 45, 47 and 49) which are separated by three substantially parallel fold or hinge lines (i.e., 44, 46 and 48). Subsection 49 further includes fold or hinge line 50. Subsection 43 includes a pair of opposing locking tabs C and D. Each of locking tabs C and D is defined by a pair of opposing protrusions which are dimensionally cut to attach into engagement slots 13*a* and 33*a* in secure relation. Subsection 43 further includes handle cutout 43*a* which is dimensionally cut to receive handle reinforcing clasp 23*b*. Subsection 49 includes fold or hinge line 50 and notch 49*a*. Notch 49*a* is designed to engage notch 29*a* in subsection 29 in interlocking relation so that subsections 29 and 49, which are dimensionally larger than subsections 19 and 39, form the primary foundational support for any items placed in base 10. Forth panel 41 further includes attachment flap 47*a* adjacent to subsection 47 through hinge line 52.

Figure 2A:
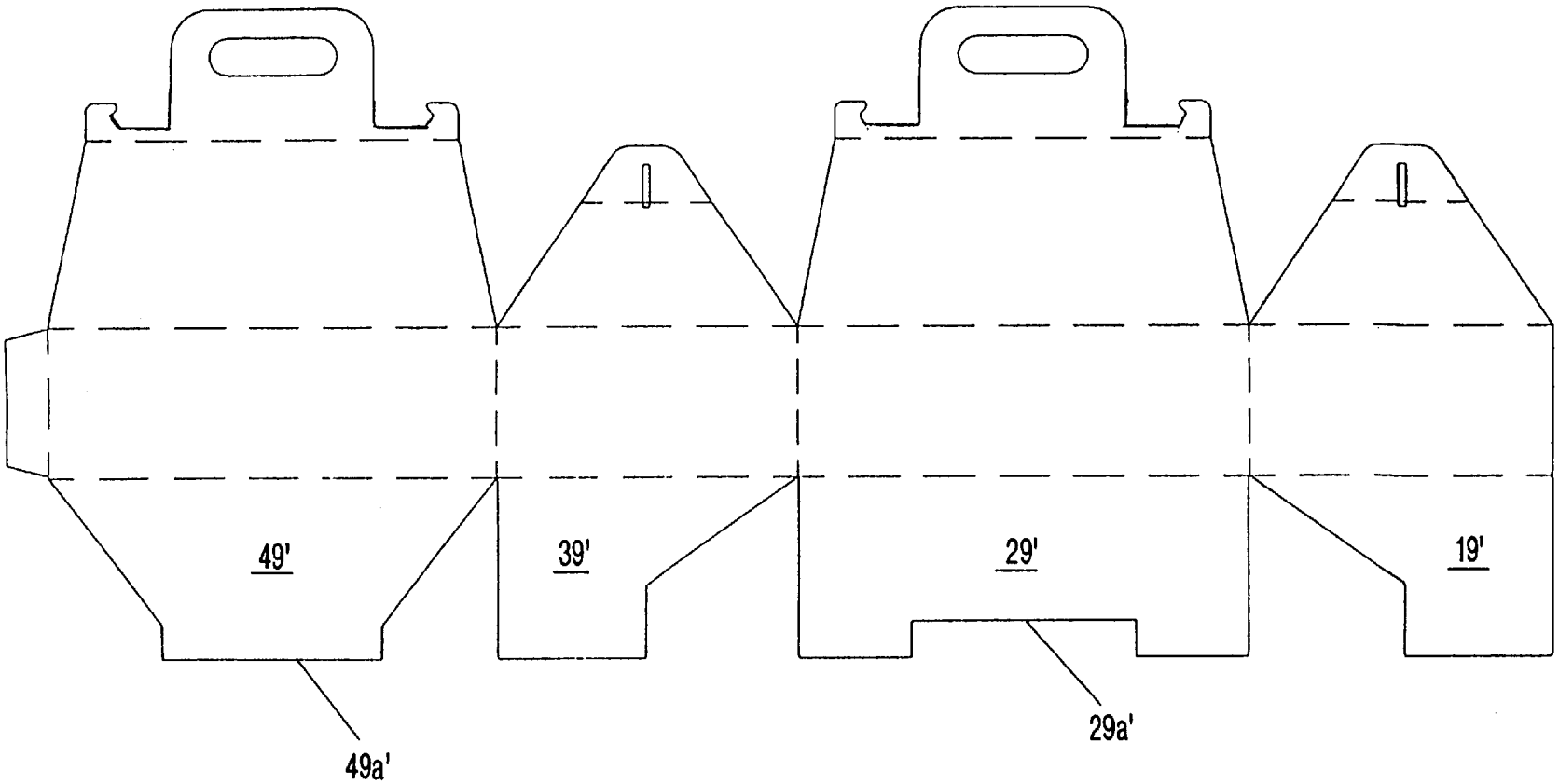
FIG. 2*a* illustrates a blank sheet from which an alternate embodiment of the present invention is formed.

When constructed for use, a user folds hinge lines 16, 22, 28, 32, 38, 42 and 48 so that subsection inboard facade 27 is in facing relation with subsection inboard facade 47, and subsection inboard facade 17 is in facing relation with subsection inboard facade 37. Notch 29*a* is then placed in engagement with notch 49*a* so that subsections 19, 29, 39 and 49 are substantially interlocked to form the base bottom as illustrated in FIG. 1 and thus, forming base compartment 55. Attachment flap 47*a* can then be securely attached (such as by glue, for example) to subsection 17 for additional structural strength of base 10. Moreover, a portion of subsection 19 can be attached securely to subsection 29 through conventional means such as glue, to provide structural stability to base 10, and similarly, a portion of subsection 39 can be attached securely to subsection 49 through conventional means. As such, subsections 17, 27, 37 and 47 form the primary inboard facade walls, whereas subsections 19, 29, 39 and 49 form the primary inboard bottom surface of base 10, all defining compartment 55. Additionally, when first and second locking means are employed, subsections 15, 25, 35 and 45 form the primary lid of base 10. As those of skill in the art will realize, the height of subsections 17, 27, 37 and 47 can be varied so that compartment 55 can be dimensionally larger to accommodate various sized items. Preferably, any outboard facade of any subsection can be imprinted with advertising media and be used as coupons or as a means for offering merchandise discounts. Finally, as illustrated in FIG. 2*a*, alternate notch 29*a*' can also be placed in engagement with alternate notch 49*a*' so that subsections 19', 29', 39' and 49' are substantially interlocked to form an alternate base bottom. This embodiment's formation of a base bottom may be preferable depending on the type of material used for sheet 10 (such as, for example. corrugated cardboard) for additional structural integrity.

Figure 3:
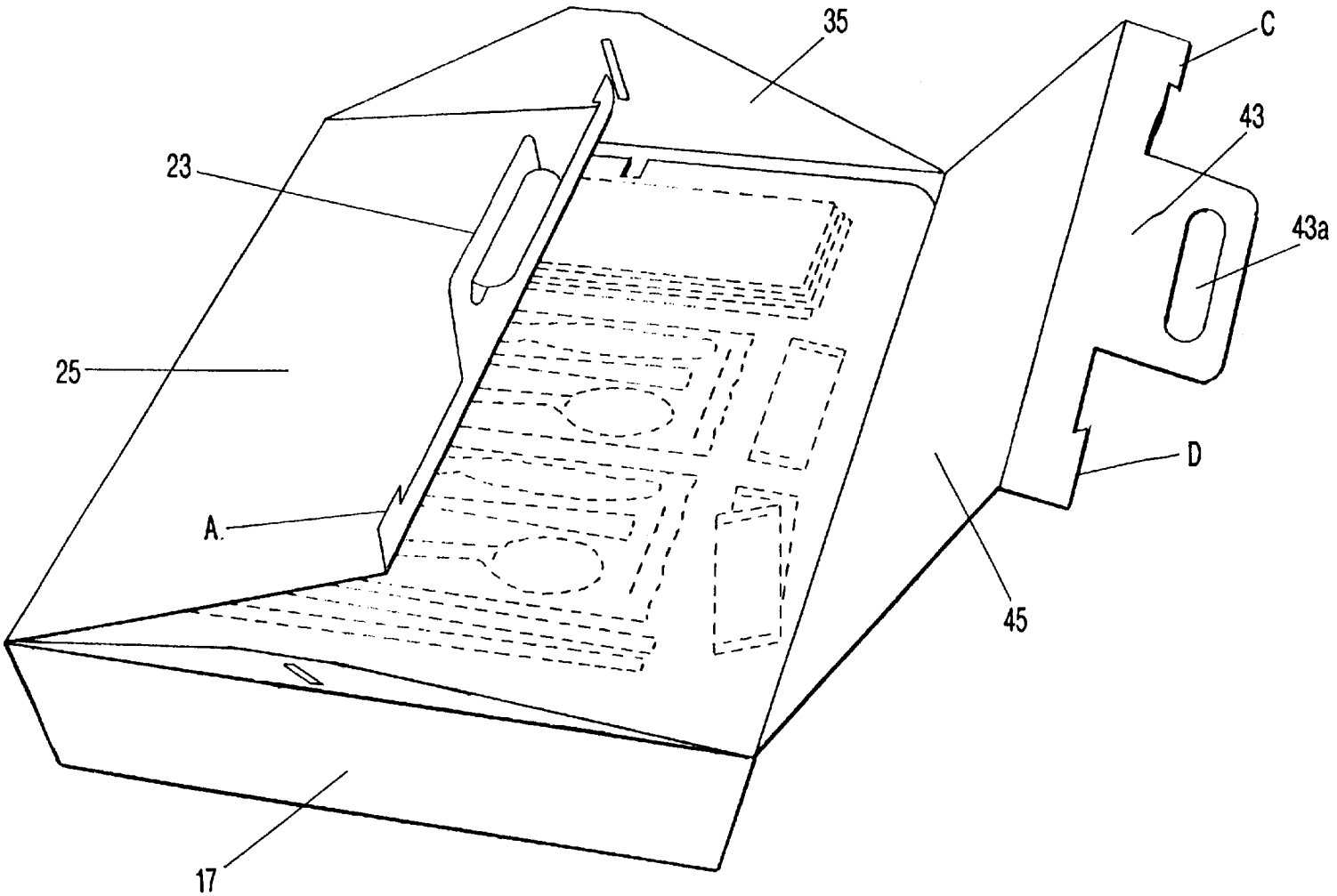
FIG. 3 illustrates the base of FIG. 1 in a partially folded position illustrating the transport of sample goods.
Figure 5:
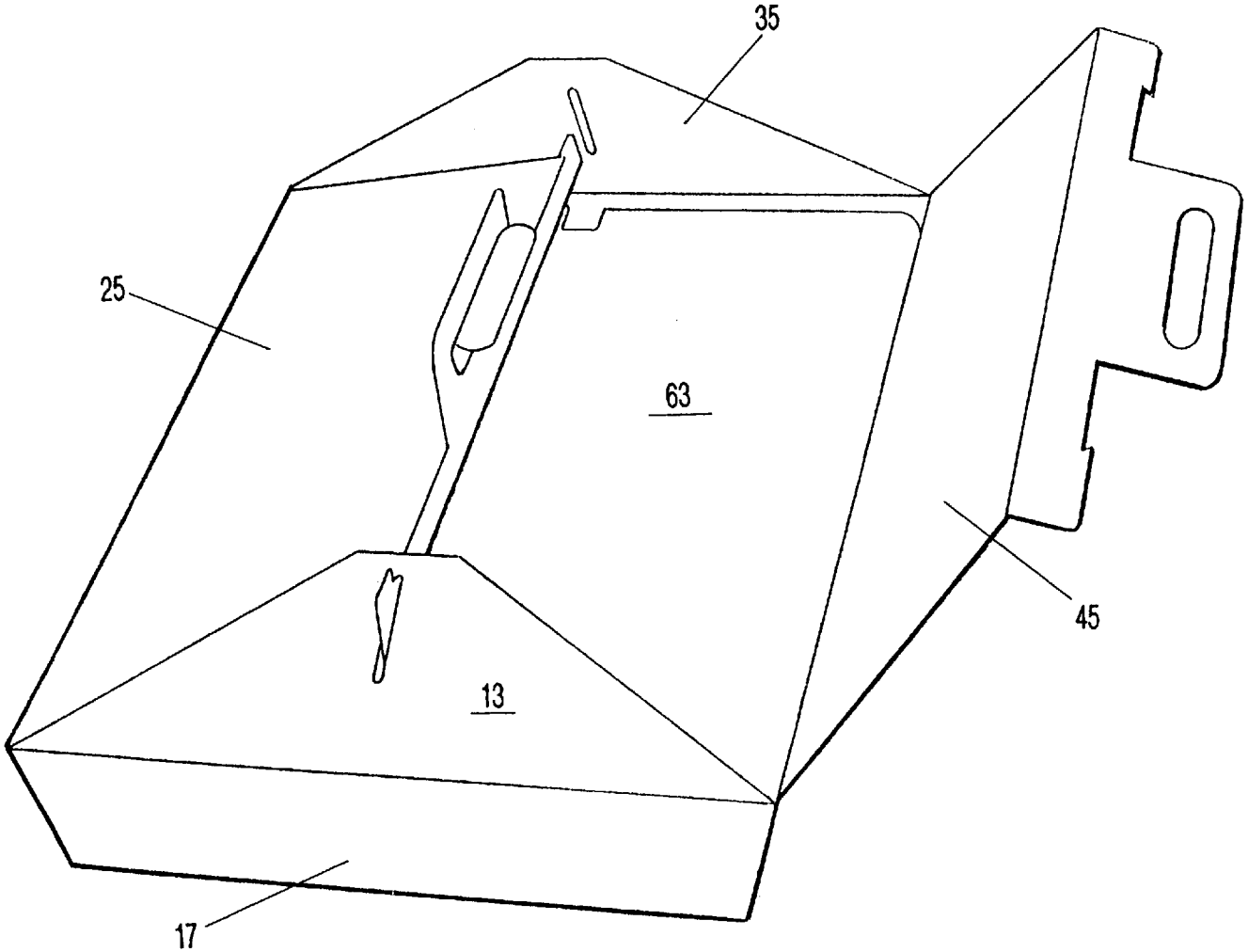
FIG. 5 depicts the base of FIG. 1 in a partially folded position illustrating a top panel's near base locking means in an engaged position with an adjacent top panel, and the far base locking means in a position of near-engagement with another adjacent top panel.

As seen in FIG. 3, utensils, food or other items can then be loaded into base 10. When loading is complete, subsection 25 is folded inward towards compartment 55 through hinge line 26 and subsection 45 is likewise folded inward towards compartment 55 until subsections 23 and 43, which define the base's handle portion, come into contact with each other. While the base is now capable of transporting items, reinforcing clasp 23*b* can then be inserted into handle cutout 43*a* to provide structural stability to base 10. Further, engagement slot 13*a* can then receive and engage locking tabs A and D as a first base locking means, and engagement slot 33*a* can then receive and engage locking tabs B and C as a second base locking means, to provide additional structural stability to base 10. Those in skill in the art will know that various other methods exist in which to form an enclosed base (e.g., such as that illustrated in FIG. 5 illustrating the engagement of locking tab A with engagement slot 13*a*), and therefore, forming the present invention is but a mere mechanical operation and not a limitation of the present invention.

Figure 4:
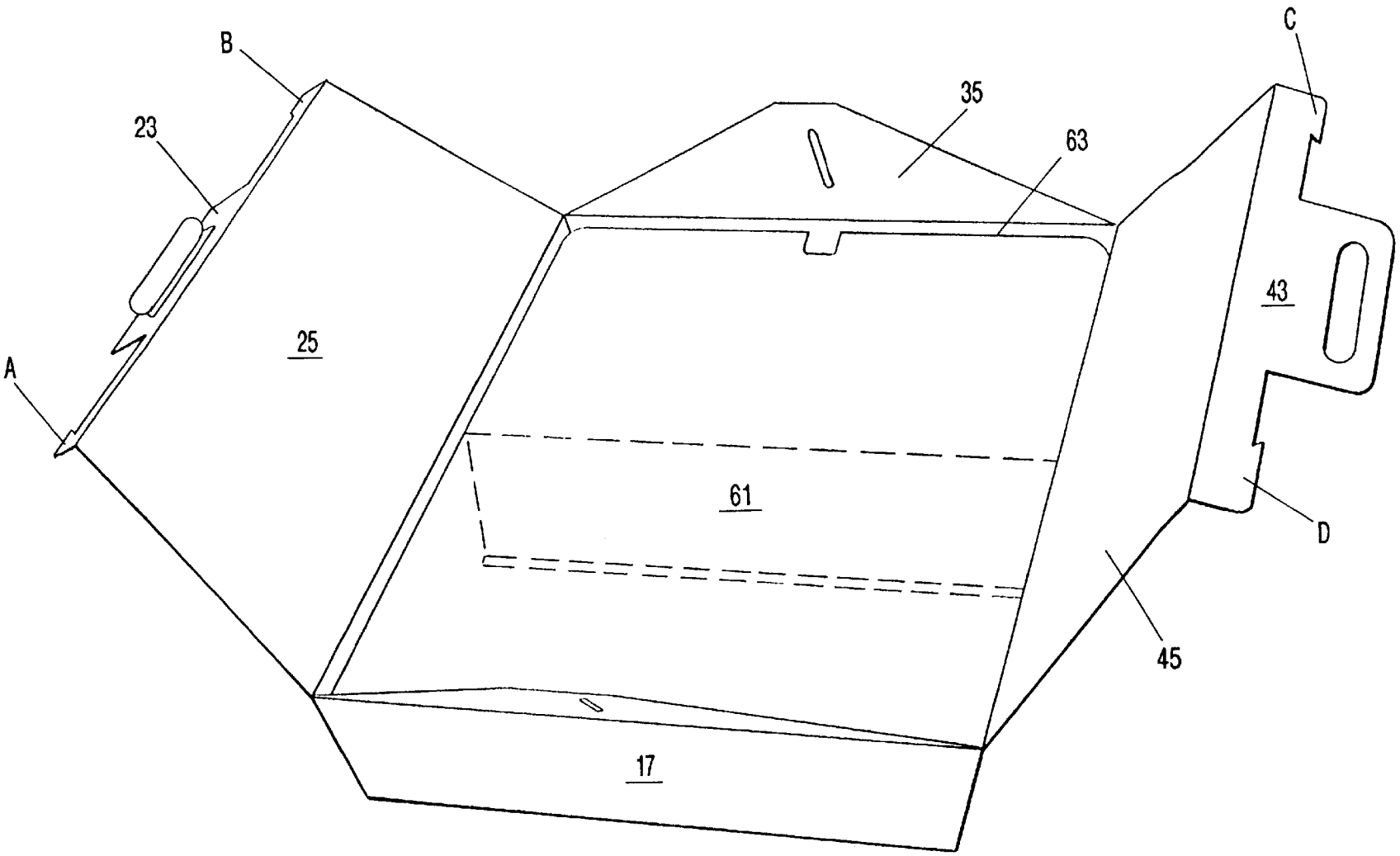
FIG. 4 illustrates the base of FIG. 1 illustrating a divider wall to thereby form one or more compartments within the base.
Figure 14:
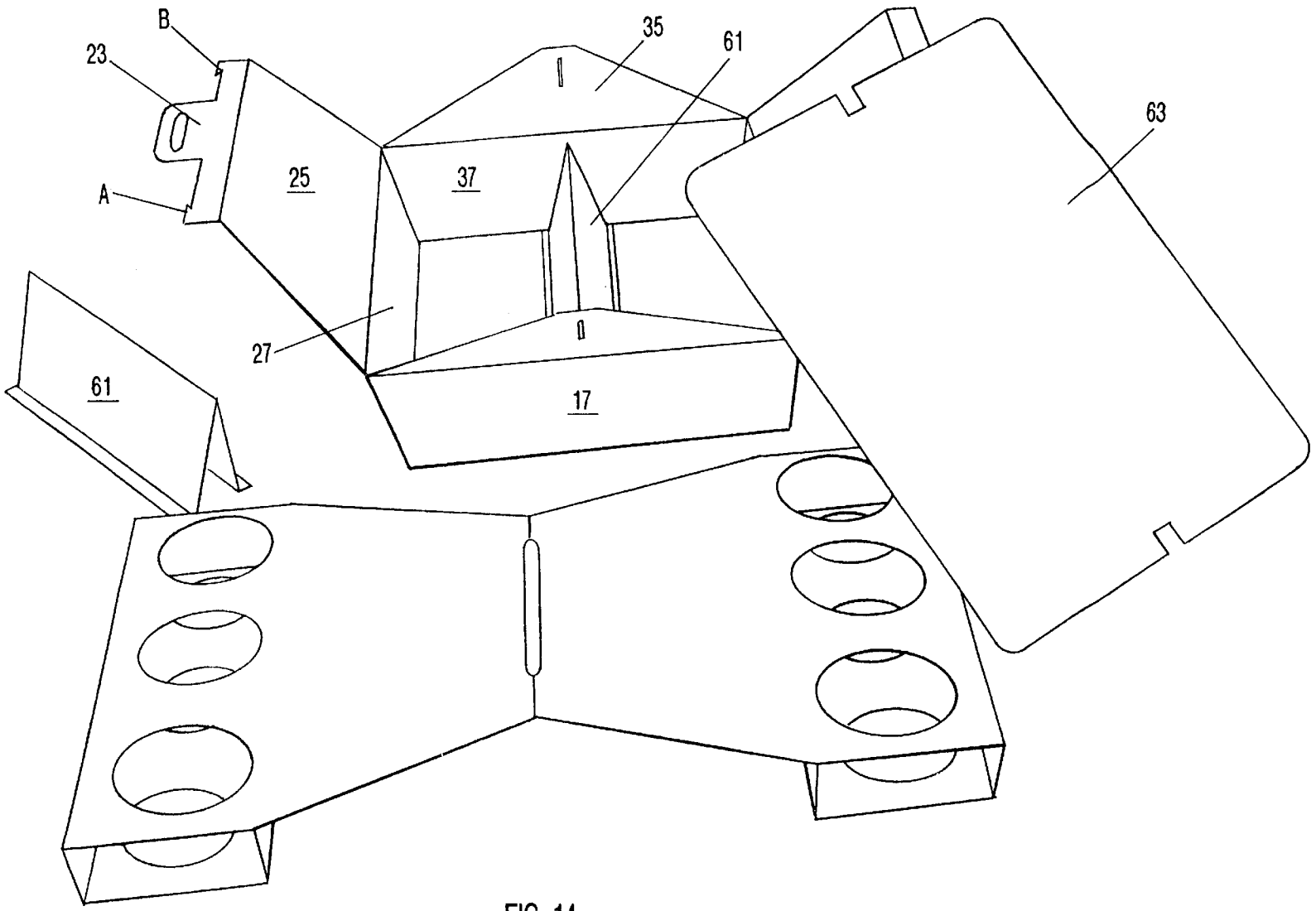
FIG. 14 illustrates an exploded side perspective view of the carrier illustrated in FIG. 13.

Optionally, at least one divider wall 61 (as seen in FIGS. 4 and 14) can be placed within compartment 55 to separate items, such as food and utensils. Divider wall 61 is preferably formed from cardboard or similar material. In the preferred embodiment, divider wall 61 is formed as an elongated inverted conical shape as seen in FIG. 14 and is placed within compartment 55 to intersect subsection inboard facade 37 and subsection inboard facade 17 (as seen in FIG. 14), but can also be used to intersect subsection inboard facade 27 and subsection inboard facade 47. As those of skill in the art will realize, divider wall 61 may be formed of any predefined shape or structure, and similarly, can either be attached to base 10 by conventional means or not, all which are mechanical design variations still within the scope of the present invention. Further, as seen in FIG. 14, at least one optional tray 63 can be employed to provide separation of items in a plane substantially parallel to the bottom formed by subsections 19, 29, 39 and 49. Tray 63 is preferably dimensioned to substantially fit within compartment 55 and formed from cardboard or similar material. Additionally, as seen in FIGS. 4 and 5, tray 63 can be placed to sit upon divider wall 61 to ensure that any contents within compartment 55 remain secure and intact during any transportation process.

Figure 6:
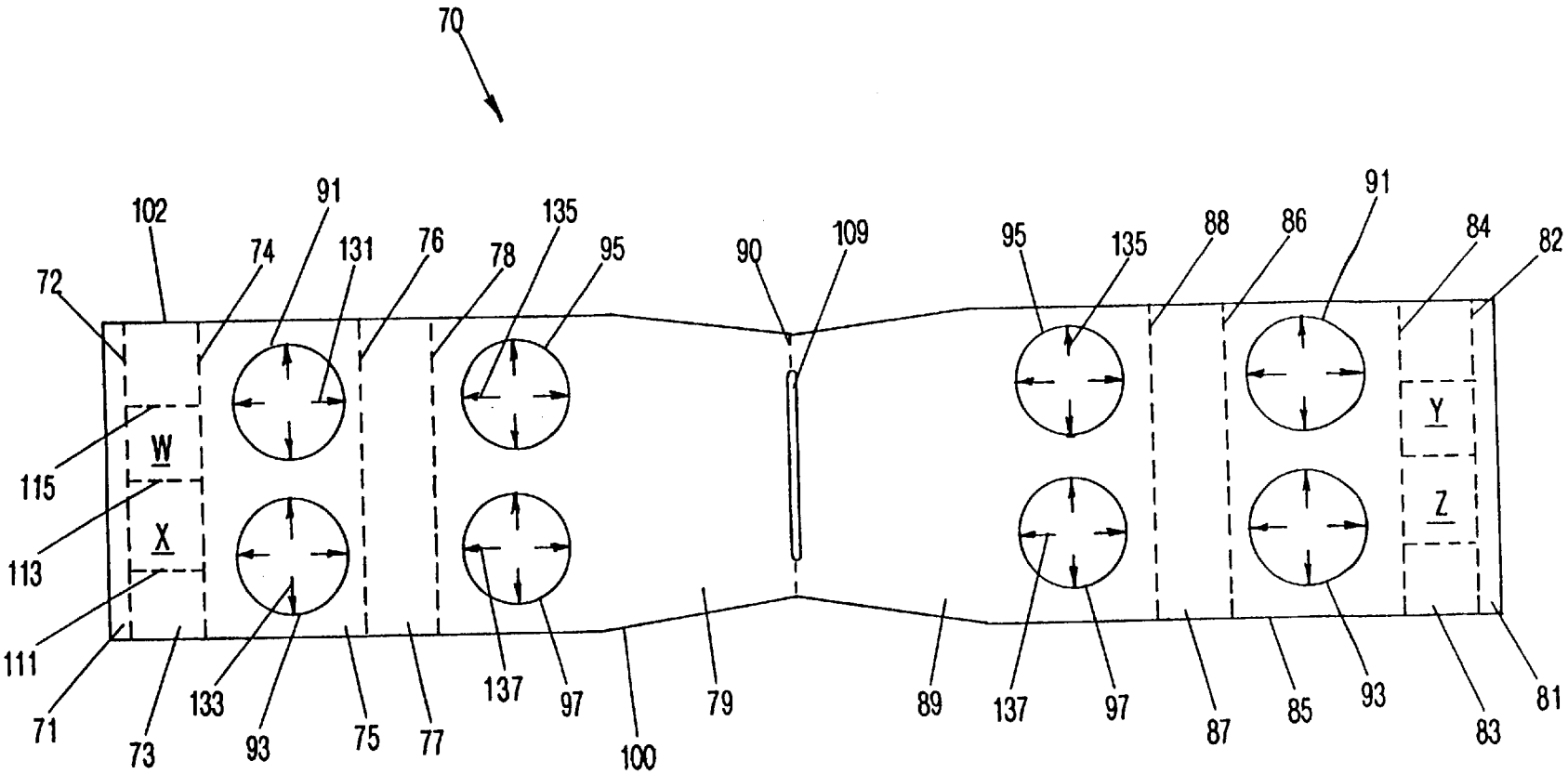
FIG. 6 illustrates a container carrier adapted to be employed with the base of FIGS. 1–5.
Figure 11:
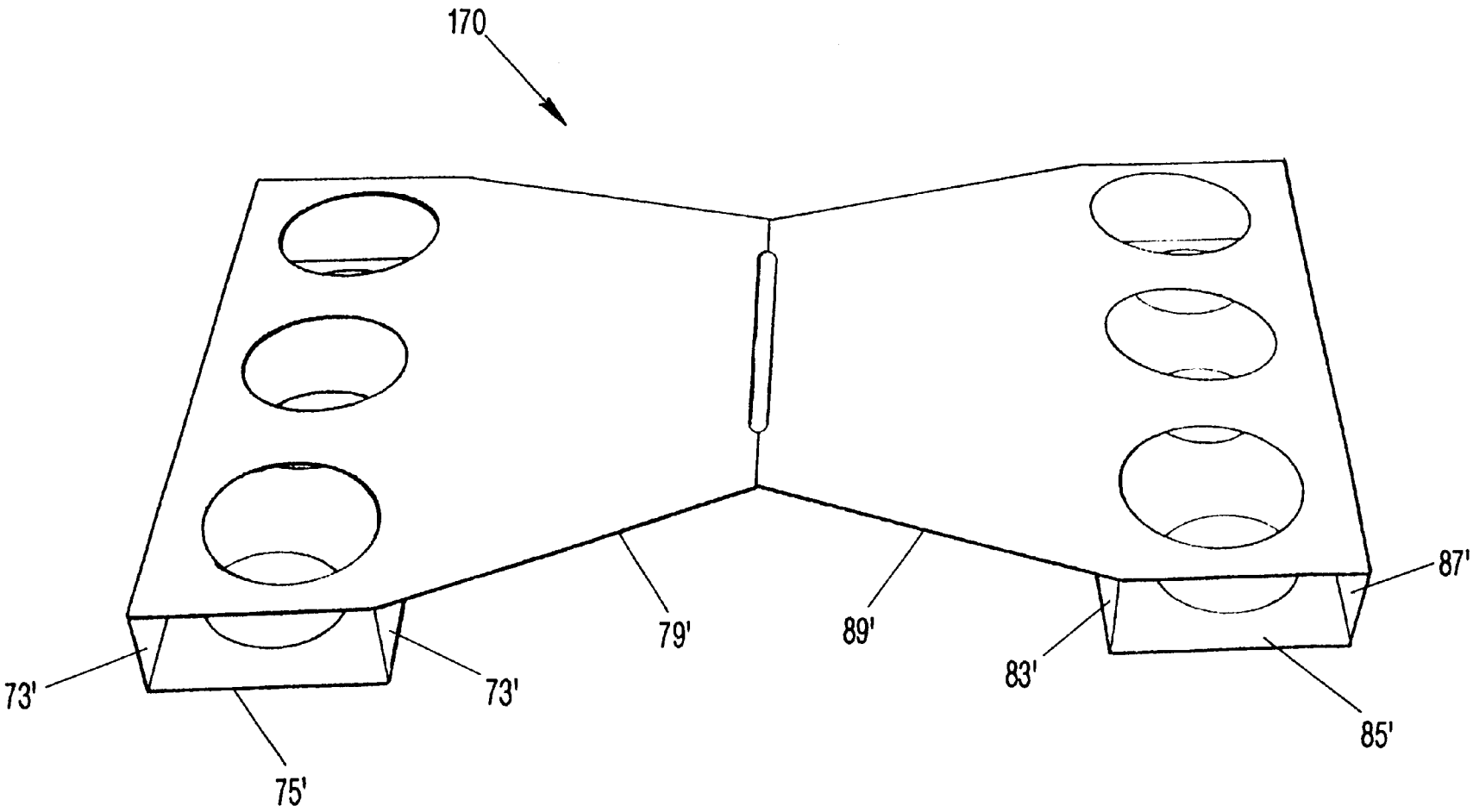
FIG. 11 is a side perspective view of an alternate container carrier.
Figure 12:
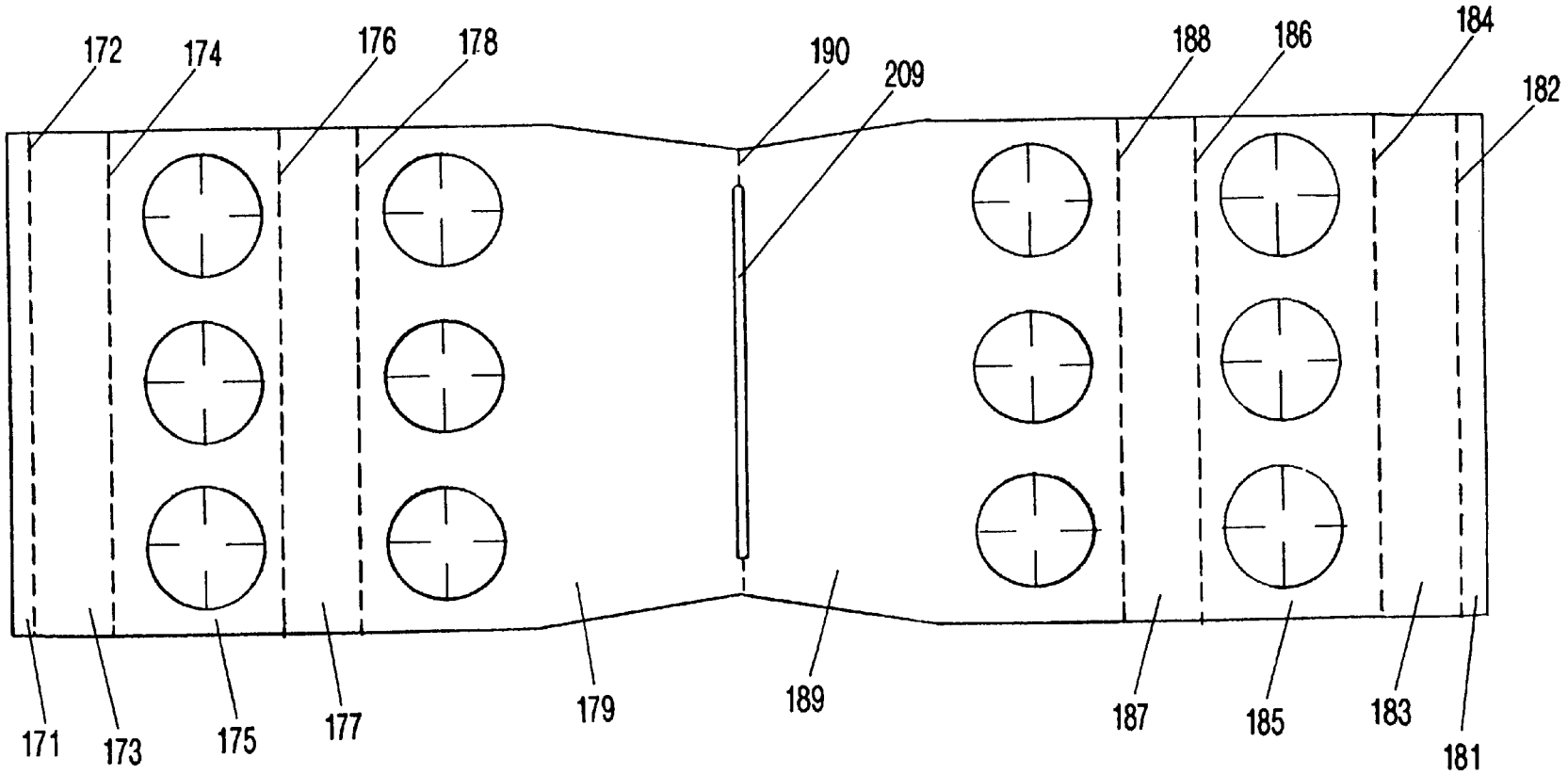
FIG. 12 illustrates a blank sheet from which the container carrier of FIG. 11 is formed.

FIG. 6 illustrates a four container carrier which can be employed with base 10 of FIGS. 1–5 and is constructed in accordance with principles of the present invention. The container carrier is made by folding a sheet of cardboard 70 or other foldable sheet material in the configuration as best illustrated in FIG. 11.

As seen in FIG. 6, sheet 70 is divided into ten primary sections or panels (i.e., 71, 73, 75, 77, 79, 81, 83, 85, 87 and 89) by nine substantially parallel fold or hinge lines (i.e., 72, 74, 76, 78, 82, 84, 86, 88 and 90). Hinge lines 72, 74, 82 and 84 are also partially perforated. Most of the panels are substantially similar in size and dimension: the first and tenth panels (71, 81); and the fourth and seventh panels (77, 87). The remainder of the panels are also substantially similar in size and dimension, but further include various other features. For example, the second and ninth panels (73, 83) further include perforated lines 111, 113 and 115. And, the third and eighth panels (75, 85) both further include a pair of equally spaced apart identical openings 91, 93. In the preferred embodiment, openings 91, 93 are elliptical so that each of openings 91, 93 has its principle or major diameter 131 parallel to edges 100 and 102, and its minor diameter 133 perpendicular to edges 100 and 102. Additionally, the fifth and sixth panels (79, 89) both further include a pair of equally spaced apart identical openings 95, 97. In the preferred embodiment, openings 95, 97 on fifth panel 79 are disposed adjacent to hinge line 78, whereas openings 95, 97 on sixth panel 89 are disposed adjacent to hinge line 88. Further, in the preferred embodiment, each of opening 95, 97 are elliptical so that each of openings 95, 97 has its principle or major diameter 137 perpendicular to edges 100 and 102, and its minor diameter 135 parallel to edges 100 and 102. Finally, a slot 109 is formed at hinge line 90 and is dimensionally suited to engage the length of subsection 23 and 43's protruding portions and a width equal to the combined width of subsection 23 and 43's protruding portions.

Figure 7:
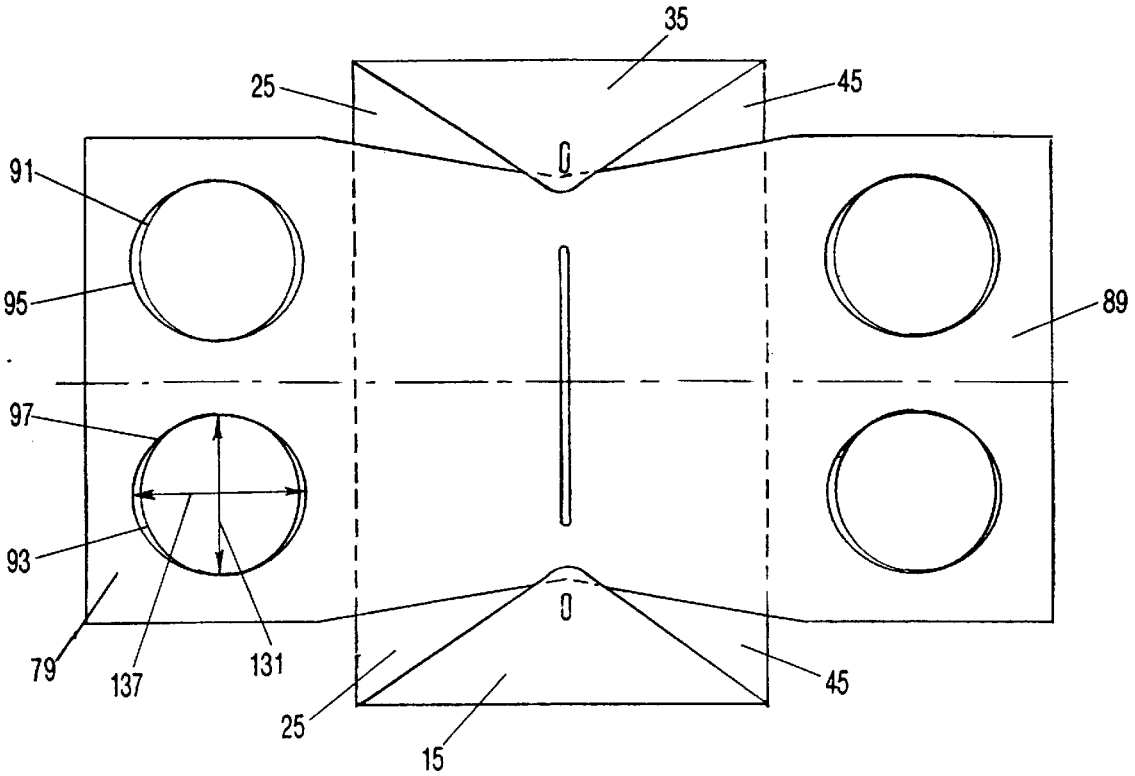
FIG. 7 is a top plan view of the carrier illustrated in FIG. 6 when in use with the base of FIGS. 1–5.
Figure 8:
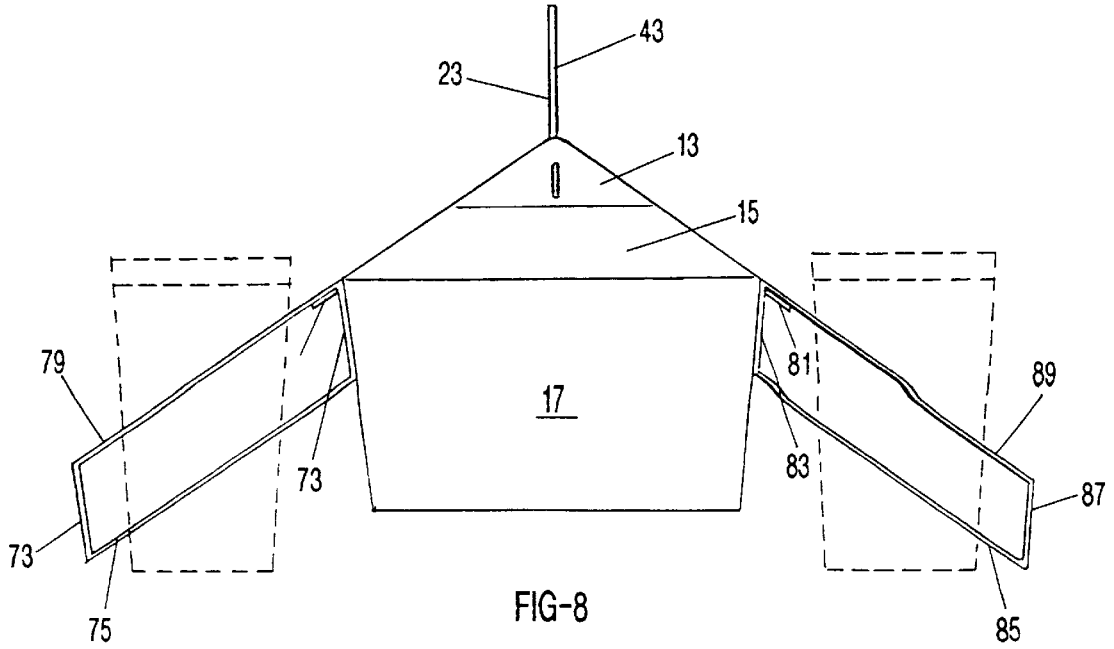
FIG. 8 is a side view of the carrier illustrated in FIG. 6 when in use with the base of FIGS. 1–5.
Figure 9:
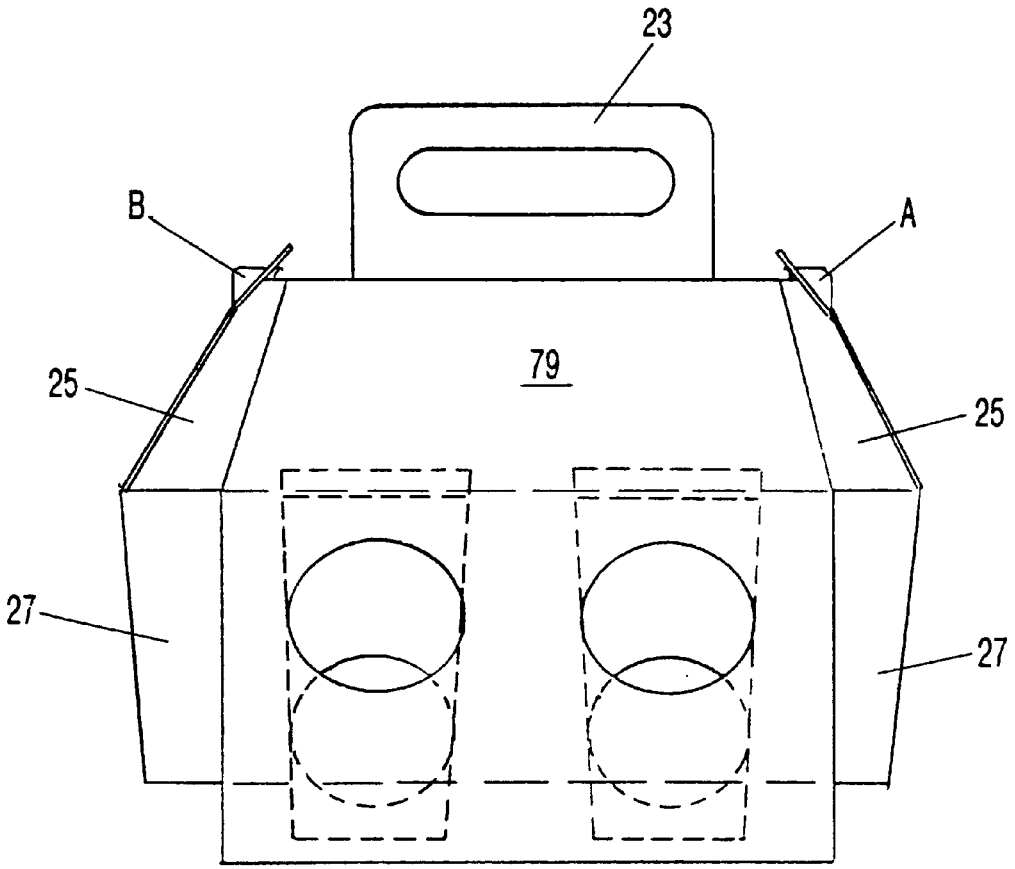
FIG. 9 is another side view of the carrier illustrated in FIG. 6 when in use with the base of FIGS. 1–5.
Figure 10:
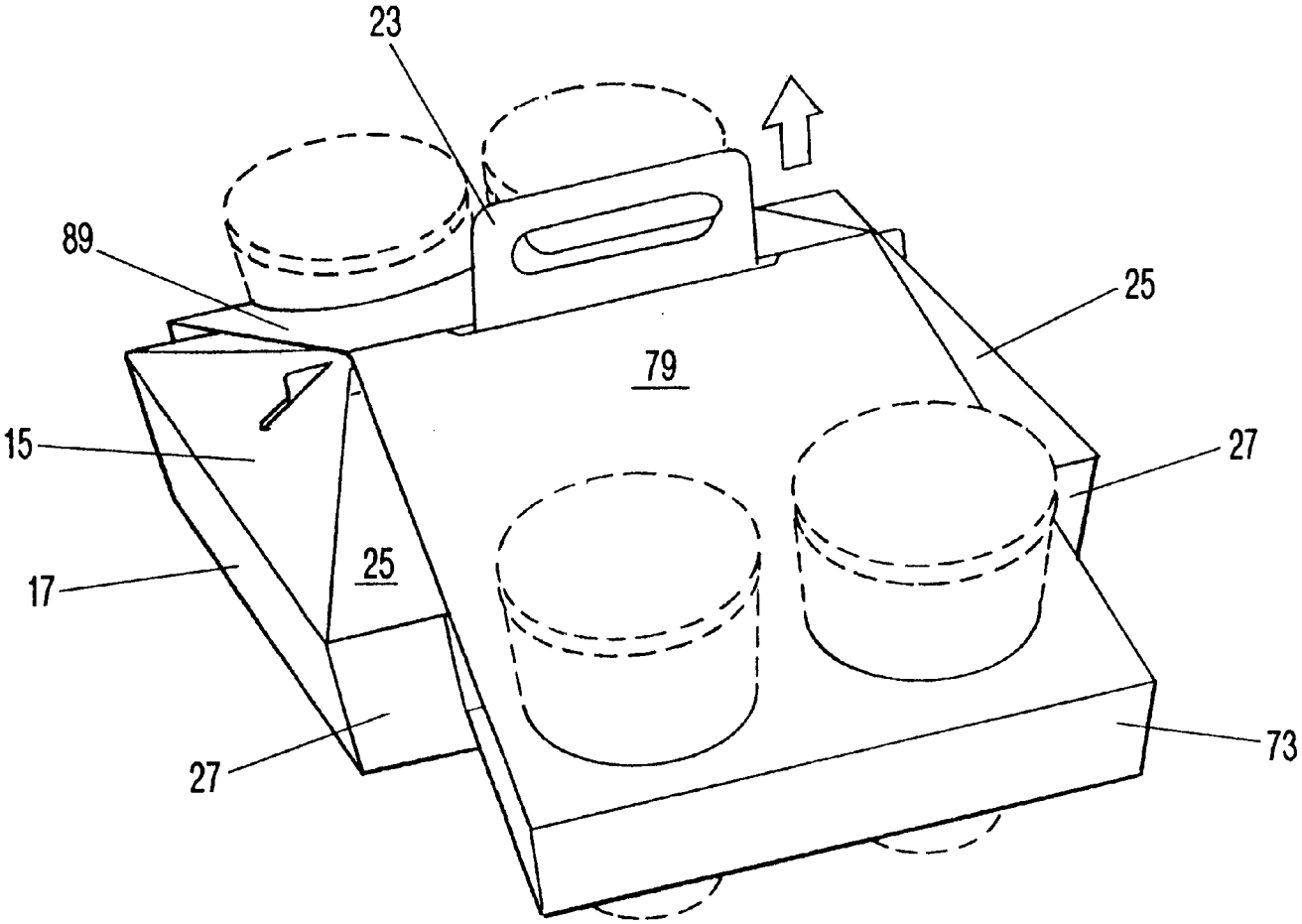
FIG. 10 is a side perspective view of the embodiment illustrated in FIGS. 7–9.

When carrier container is constructed for use, panels 71, 73, 75 and 77 are folded along hinge lines 72, 74, 76, 78 so that the outboard facade of panel 71 is immediately adjacent to the inboard facade of panel 79 as shown in FIG. 8. Similarly, panels 81, 83, 85 and 87 are folded along hinge lines 82, 84, 86 and 88 so that the outboard facade of panel 81 is immediately adjacent to the inboard facade of panel 89 as shown in FIG. 8. With this construction, panel 73's outboard facade is in substantially facing relation with panel 83's outboard facade. Further, with this construction, openings 93 on the third and eighth panels (75, 85) are in substantial registry with openings 97 on the fifth and sixth panels (79, 89) as seen in FIG. 7. Similarly, openings 91 on the third and eighth panels (75, 85) are in substantial registry with openings 95 on the fifth and sixth panels (79, 89) as seen in FIG. 7. Thus, when carrier 10 has been manufactured, it is completely folded for ease in packing, transportation, and storage prior to use by a fast food vendor, and is provided with rounded edges on all exposed corners for safety to patrons.

With the arrangement and constructions as illustrated in FIGS. 6–10, openings 91, 93 in section 75 are aligned with openings 95, 97 in section 79. If the openings are elliptical, as required by the preferred embodiment, this alignment is best illustrated in FIG. 7, wherein major diameter 137 of opening 97 is perpendicular to major diameter 131 of opening 93. As is also best illustrated in FIG. 7, elliptical opening 93 is smaller than elliptical opening 97. In order for such openings to both hold a container cup (which is typically conical in shape, such as illustrated in FIG. 8), it is critical that the openings be elliptical in shape, with crossing major diameters (as illustrated in FIG. 7). If round apertures are used, the bottom aperture does not hold a container with equal pressure, thereby reducing the reliability of carrier 10, especially if carrier 10 is moist or damp. In contrast, the elliptical apertures hold a container with almost equal pressure, thereby holding the container more firmly and upright.

Finally, the portions denoted by W, X, Y and Z in FIG. 6 are designated to be similar to credit-card sized dimensions so that customers may tear apart these portions from the carrier container and use these portions as valuable coupons or other advertising vehicles. Therefore, companies may advertise their goods or services by using these portions both as an advertising vehicle and as a means for offering merchandise discounts or giveaways (such as, for example, a money card, a phone card or similar smart card having a magnetic strip thereon which contains electronic information). Therefore, portions W, X, Y or Z illustrated in FIG. 6 can be imprinted with advertising media and be used as coupons or as a means for offering merchandise discounts.

In use, both base 10 and container carrier 70 are constructed accordingly. If desired, base 10 can be used by itself to carry food, utensils and other items from the fast-food counter. If beverages are ordered, however, container carrier 70 can be employed to assist, in saddle fashion, the carrying and transportation of both food and/or beverages. In this manner, base 10 is first loaded with food or other items as desired, and its lid is closed so that subsection 25 is folded inward towards compartment 55 through hinge line 26 and subsection 45 is likewise folded inward towards compartment 55 until handle portions 23 and 43 come into contact with each other. Preferably, both first and second locking means are engaged to provide additional structural support to base 10. Next, the operator will slide container carrier 70 onto base 10 by sliding base's handle portion (defined by subsection 23, 43) through container carrier's slot 109 completely until the bottom surface of container carrier 70 rests upon the lid and side walls of base 10 as shown in FIGS. 7–10. In this fashion, the outboard portion of carrier's second and ninth panels (73, 83) will rest against the outboard portion of base's subsection 27 and 47. Now, beverage containers can be loaded into openings 95, 97 with confidence that little to no spillage will occur. When loading of beverage containers is complete, the purchaser can simply grab base's handle portion (23, 43) and carry and transport away food and beverage items.

Figure 13:
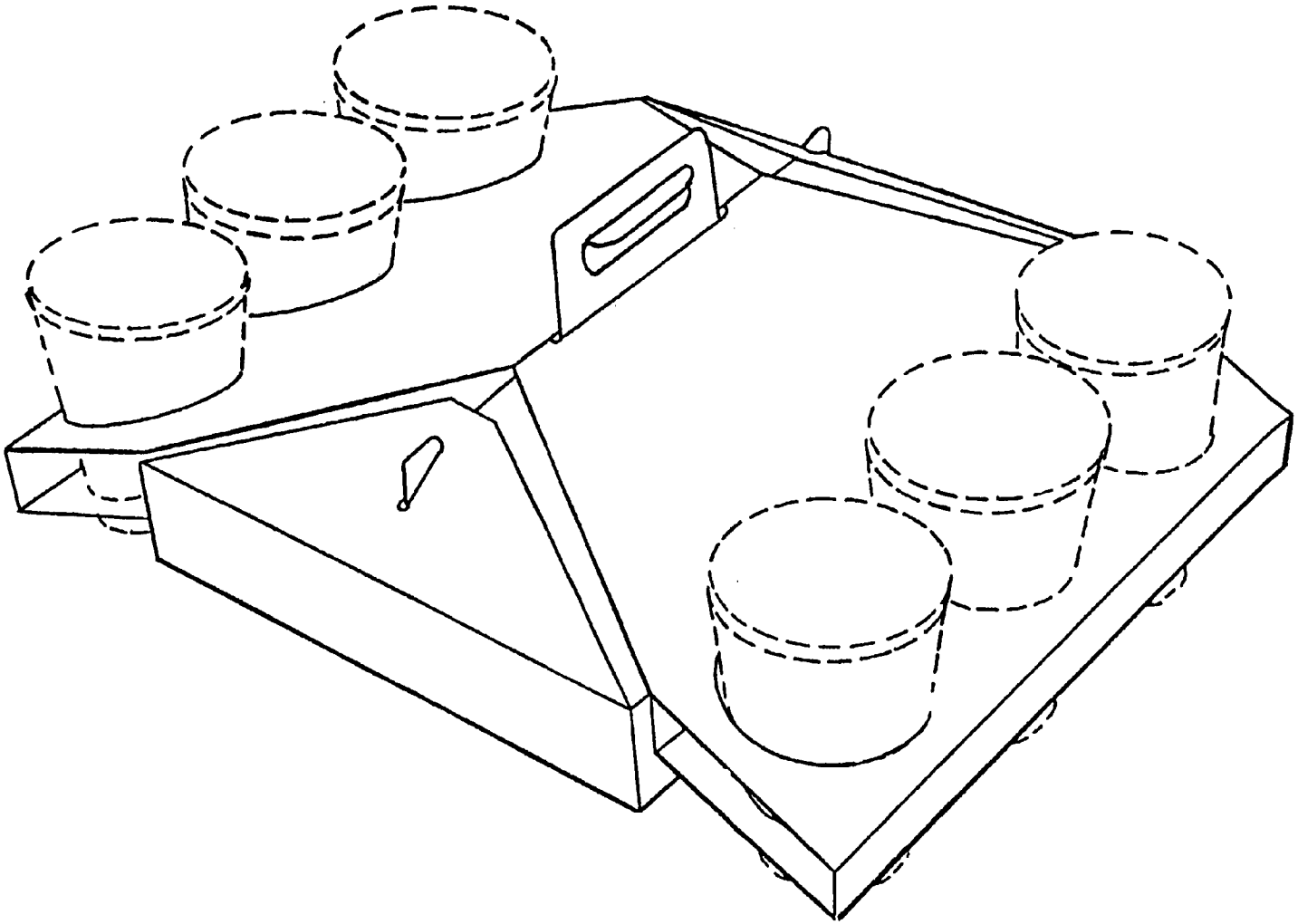
FIG. 13 illustrates a side perspective view of the carrier illustrated in FIG. 11 when in use with the base of FIGS. 1–5.

An alternate container carrier 170 is illustrated in FIGS. 11–14. Carrier 170 is substantially similar to carrier 70, but is not limited to the number of openings formed thereon. Thus, while FIGS. 11–14 illustrate a carrier 170 with three openings, those of skill in the art will realize that through the present disclosure, and without undue experimentation, any number of openings of various sizes can be formed on a container carrier which can then be employed with a base (such as, for example, as shown in FIG. 13). Thus, the number of openings formed on the container carrier is predetermined by the operator.

Whereas the drawings and accompanying description have shown and described the preferred embodiment of the present invention, it should be apparent to those skilled in the art that various changes may be made in the form of the invention without affecting the scope thereof. For instance, the support panel apertures may be made in different sizes to accept different size drinking cups. The entire carrier may itself be made in different sizes with differing numbers of cup-receiving apertures, so as to readily accept two, four, six or even eight cups.

I claim:

1. A container carrier comprising:

(a) a sheet having an inboard and outboard facade, the sheet further having a first panel and a second panel, the first panel attached to the second panel by a foldable hinge line, the first panel having at least one primary opening therein, the second panel having at least one primary opening therein, the first panel and second panel being mirror structures of each other along the foldable hinge line;

(b) a first series of panels attached to the first panel along a second hinge line, the first series of panels including one panel having at least a secondary opening therein, the first series of panels further including a last panel, the last panel having an outboard facade which, when attached to the inboard facade of the first panel, allows the first panel's primary openings to be in substantial registry with the last panel's secondary openings; and (c) a second series of panels attached to the second panel along a third hinge line, the second series of panels including one panel having at least a secondary opening therein, the second series of panels further including a last panel, the last panel having an outboard facade which, when attached to the inboard facade of the second panel, allows the second panel's primary openings to be in substantial registry with the last panel's secondary openings; and (c) a slot formed substantially along the foldable hinge line, the slot being sized and dimensioned to receive a handle of predetermined size and length.

2. The container carrier of claim 1 wherein the sheet's outboard facade is imprinted with advertising media and offers for merchandise discounts.

3. The container carrier of claim 2 wherein all primary and secondary openings are elliptical and have both a major axis and a minor axis, the major axis of the primary openings being substantially perpendicular to the major axis of the secondary openings.

4. The container carrier of claim 3 wherein all primary openings are dimensionally larger than all secondary openings.

5. A container carrier for use in conjunction with a base having a bottom attached to at least four walls and further having an elongated handle portion of predetermined width and thickness, the base further having a first side defined by a first exterior surface of one of the four walls and a second side defined by a second exterior surface opposite from the first exterior surface, the carrier comprising a first opening portion for holding at least one container on the first side of the base, and further including a second opening portion for holding at least one container on the second side of the base, the first opening portion being attached to the second opening portion through a foldable hinge line, the carrier having a slot formed along the length of the foldable hinge line to receive the handle portion, and further including a first means for fixedly positioning the carrier on the base when the slot receives the handle portion, the first means for fixedly positioning the carrier being attached to the first opening portion through a foldable hinge line, and further including a second means for fixedly positioning the carrier on the base when the slot receives the handle portion, the second means for fixedly positioning the carrier being attached to the second opening portion through a foldable hinge line, the first means for fixedly positioning the carrier on the base rests upon at least one of the base's side walls and wherein the second means for fixedly positioning the carrier on the base is adapted to rest upon an opposite base side wall, the first means for fixedly positioning the carrier on the base further includes a third opening portion for holding at least one container on the first side of the base, and the second means for fixedly positioning the carrier on the base further includes a fourth opening portion for holding at least one container on the second side of the base, and wherein each of the first and second opening portion's are elliptical holes having both a major and a minor axis, and wherein each of the third and fourth opening portion's are elliptical holes, having both a major axis and a minor axis, the first and second opening portion's holes being in perpendicular orientation relative to the third and fourth opening portion's elliptical holes.

6. The container carrier of claim 5 wherein each of the first and second opening portions's elliptical holes are dimensionally larger than each of the each of the third and fourth opening portion's holes.

* * * * *